US006201349B1

(12) United States Patent
Pfaffel

(10) Patent No.: US 6,201,349 B1
(45) Date of Patent: Mar. 13, 2001

(54) ELECTRODE WITH A HELICAL ATTACHMENT

(75) Inventor: Johann Pfaffel, Ingolstadt (DE)

(73) Assignee: Patent-Truehand-Gesellschaft fuer elektrische Gluelampen mbH, Munich (DE)

( * ) Notice: Subject to any disclaimer, the term of this patent is extended or adjusted under 35 U.S.C. 154(b) by 0 days.

(21) Appl. No.: 09/248,791

(22) Filed: Feb. 12, 1999

(30) Foreign Application Priority Data

Mar. 4, 1998 (DE) ..... 198 08 981

(51) Int. Cl.[7] ..... H01J 61/06

(52) U.S. Cl. ..... 313/631; 313/628; 313/574; 313/631; 313/632; 313/335

(58) Field of Search ..... 313/631, 628, 313/570, 571, 574, 577, 632, 333, 335, 344, 350

(56) References Cited

U.S. PATENT DOCUMENTS 4,812,710 3/1989 Klam et al. ..... 313/579
5,451,837 9/1995 Stevens et al. ..... 313/628

FOREIGN PATENT DOCUMENTS

9530237 * 11/1995 (WO) ..... H01J/61/073

* cited by examiner

*Primary Examiner*—Frank G. Font
*Assistant Examiner*—Andrew H. Lee
(74) *Attorney, Agent, or Firm*—William H. McNeill

(57) ABSTRACT

An electrode for electrical lamps comprises a core pin with a pushed-on helical member. A boss (9) projecting beyond the diameter of the core pin (7) is laterally constructed on the core pin at a spacing from the tip, the helical member (8) being arranged with at least one turn behind the boss.

8 Claims, 5 Drawing Sheets

ELECTRODE WITH A HELICAL ATTACHMENT

TECHNICAL FIELD

The invention proceeds from an electrode in accordance with the preamble of claim 1. At issue here, in particular, are electrodes for high-pressure discharge lamps, but also holders for the helically wound luminous elements of an incandescent lamp.

PRIOR ART

U.S. Pat. No. 5,451,837 has already disclosed an electrode for high-pressure discharge lamps in which the core pin has a symmetrical notch or a symmetrical bulge. The aim is to ensure better retention for the pushed-on helix. The disadvantage of this construction is that it is scarcely suitable for small lamp powers. The reason for this is that very small core pins are used in that case, and they are consequently difficult to work mechanically.

WO 95/30237 has disclosed a high-pressure discharge lamp for small lamp powers whose electrode is fitted with an excentric core pin. The irregular or else symmetrical deformations of the core pin extend over the entire region of the core pin onto which the helix is pushed. They must be produced with a high outlay by means of a grinding process. Such a core pin is very difficult to produce, bearing in mind that the diameter of the core pin is only of the order of magnitude of 150 to 700 $\mu$m. The mechanical working of such a small core pin by the grinding process described requires a very high outlay and is subject to a high rejection rate.

U.S. Pat. No. 4,812,710 has disclosed a halogen incandescent lamp whose electrodes hold the doubly helically wound luminous element as inner supply leads. Constructed on the ends of the supply leads are symmetrical flats over which the end of the luminous element is pushed. This arrangement is difficult to automate.

SUMMARY OF THE INVENTION

It is the object of the present invention to provide an electrode in accordance with the preamble of claim 1 which can be produced easily and with a low rejection rate and permits the pushed-on helix to be held very reliably.

This object is achieved by means of the characterizing features of claim 1. Particularly advantageous refinements are to be found in the dependent claims.

The electrode according to the invention is produced from high-melting, electrically conducting material, preferably tungsten, although molybdenum or tantalum may also be considered. The electrode comprises a core pin, which normally has a cylindrical cross section, but can also be elliptical or flattened. A helical member is pushed onto the end of this core pin. It can project at the tip of the core pin, or also already terminate before it. In the case of high-pressure discharge lamps, this helical member can either regulate the heat budget of the electrode, or serve as a holder for an emitter material inserted between the turns of the helical member. In the case of an incandescent lamp, preferably a halogen incandescent lamp, the electrode is constructed as an inner supply lead. The pushed-on helical member is the end of the luminous element in this case.

According to the invention, a boss projecting beyond the diameter of the core pin is laterally constructed on the core pin at a spacing from the tip. A typical value for the projection of the boss is 10 $\mu$m. In this case, the helical body is pushed onto the core pin with at least one turn as far as behind the boss.

It is advantageous to arrange a second boss on the side of the core pin opposite the first boss. This improves the retention of the helical member. It is preferred for the second boss to be arranged offset with respect to the first boss, specifically such that the spacing between the two bosses measured on the longitudinal axis is adapted to the geometry of the helical member. If the helical member is wound without a pitch, so that the individual turns touch one another, offsetting the second boss by half the wire diameter of the helical member is particularly suitable. If the helical member is wound with a pitch, so that the individual windings are spaced apart, it is advantageous for the two bosses to be offset with respect to one another by half the pitch of the helical member. It is always ensured in this way that the helical member latches between the two bosses and is held there optimally.

In principle, it is also possible to use more than two bosses in the case of a relatively long helical member.

A particularly secure retention is achieved in the case of an electrode for a high-pressure discharge lamp when the boss(es) is or are arranged approximately centrally relative to the helical member. In this case, the helical member is singly helically wound and comprises approximately four to ten turns. The self-retaining force of such a helical member owing to spring action is relatively slight. A relatively large projection of the boss beyond the surface of the core pin is preferred in this case. A typical value is 10 to 30 $\mu$m.

The doubly helically wound ends of the luminous element are frequently used as helical members for halogen incandescent lamps. These ends have a large spring action with a high self-retaining force, so that a relatively slight projection (5 to 10 $\mu$m) suffices in this case.

This retaining system based on bosses on the core pin is particularly suitable for lamps of low power, for example between 35 and 150 W. With these lamps, the electrodes are very small and can be mechanically worked only with difficulty. Typical diameters of the core pin are approximately 150 to 1000 $\mu$m. The retaining system presented here is, however, in principle also still suitable for larger diameters of the core pin, for example up to 5 mm. The wire diameter of the helical member is preferably approximately 10 to 50% of the diameter of the core pin.

So that the helical member is securely retained on the core pin, it is expedient for the projection of the boss beyond the core pin to be approximately 5 to 30 $\mu$m. The diameter of the wire for the helical member is of the order of magnitude of approximately 50 to 500 $\mu$m. Whereas in the case of known retaining techniques which are based on a change in the cross section of the core pin the circumference of the core pin remains unchanged or greatly enlarged, in the case of the retaining technique according to the invention it is effectively only slightly enlarged, specifically by approximately 3 to 10%. The particular advantage of the retaining technique according to the invention is, in this case, that the use of the two offset bosses whose spacing is adapted to the turns of the helical member permits an optimum retaining effect to be achieved without a large outlay of force. Threading the helical member can be done easily and reliably. Overall, this retaining technique can be automated very easily and is subject to a low rejection rate. Because the enlargement of the circumference of the core pin in the region of the individual boss can be kept relatively small, it is possible to produce it by a simple stratagem.

A particularly suitable method for producing an electrode as described above consists in that a core pin is irradiated laterally with a laser beam so that the material of the core pin melts locally and forms a boss, the helical member subsequently being pushed onto the core pin beyond the boss. This method can easily be modified (for example by means of a beam splitter) such that a core pin is simultaneously irradiated from two sides with a laser beam, so that two bosses are formed. The laser beam, generally a high-power Nd:YAG laser with a wavelength of 1064 nm is focused in this case onto the location of the core pin provided for forming the boss. The power of the laser is set such that the material of the core pin melts and owing to the surface tension, forms a knob(boss) which is frequently located in a depression. In the case of this working technique, the material of the core pin is neither removed nor added to. It is merely rearranged. The depression constructed around the boss is, however, so narrow that the helical member does not notice the depression, but instead does indeed sense the projection of the boss very well.

In the case of the known notches and flats on the core pin, the helical member must be pressed into the depressions thereby produced in the core pin. The notches or flats are symmetrical, so that because of the offsetting of the turns of the helix only a part of the helical member is effectively anchored in the notch or flat. By contrast with this, the diameter of the core pin is now enlarged by the boss in a more punctiform way. The pushed-on helical member can slide easily over the boss when it is applied to the core pin with appropriate force. The force required for this can be measured and evaluated and used as a means of testing for any rejection required. In the case of two bosses spaced apart, a particularly effective meshing of the helical member with the core pin is achieved, because here the core pin is adapted to the geometry of the helical member.

The retaining technique according to the invention permits the core pin to be handled without contact and thus with particular care when forming the bosses. This is a great advantage with regard to the use of tungsten as material, in particular, since tungsten is known to be very brittle. The self-closure between the core pin and helical member can, in particular because of the meshing in the case of two bosses—likewise be performed without a large outlay of force. A typical value of the force to be expended is approximately 10 N. Thus, high stressing of the brittle core pin is avoided twice: the first time when creating the boss, and the second time when pushing the helical member on.

A typical value for the material turnover in the formation of a boss is approximately 20% of the disc-shaped volume affected. This value decreases in the case of larger values of the diameter of the core pin. Beyond a certain range of values of the diameter, this value of the material turnover can be readjusted by means of an increased laser power. Typical values of the laser power are 5 to 50 J.

FIGURES

The invention is to be explained in more detail below with the aid of a plurality of exemplary embodiments. In the drawing:

FIG. 1 shows a section through a high-pressure discharge lamp,

FIG. 2*a* shows a section through an electrode for the lamp in FIG. 1,

FIG. 2*b* shows the core pin of the electrode in top view, but slightly rotated with respect to the representation in FIG. 2*a*, FIG. 3 shows a further exemplary embodiment of an electrode for a high-pressure discharge lamp, FIG. 4 shows an exemplary embodiment of a halogen incandescent lamp with an electrode, and FIG. 5 shows a representation of the method of production for creating bosses.

Figure 1:
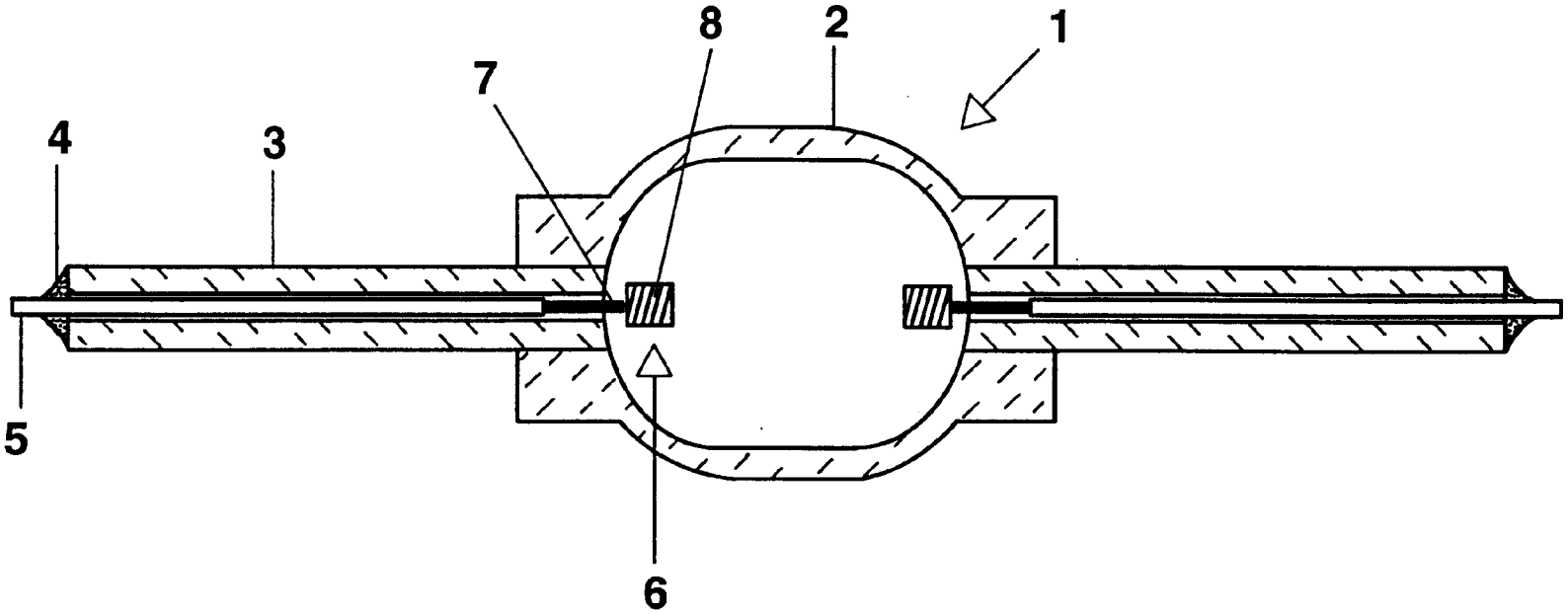
FIG. 1 shows a metal halide lamp 1 with a power of 35 W and having a ceramic discharge vessel 2 sealed at two ends. Two outer supply leads 5 are sealed into the stoppers 3 by means of solder glass 4 and are connected to electrodes 6 in the interior of the discharge vessel. The electrodes 6 comprise core pins 7 onto which a helical member 8 is pushed. Both components consist of tungsten. The diameter of the core pin is 150 $\mu$m, that of the helical member 8 is 50 $\mu$m.
Figure 2A:
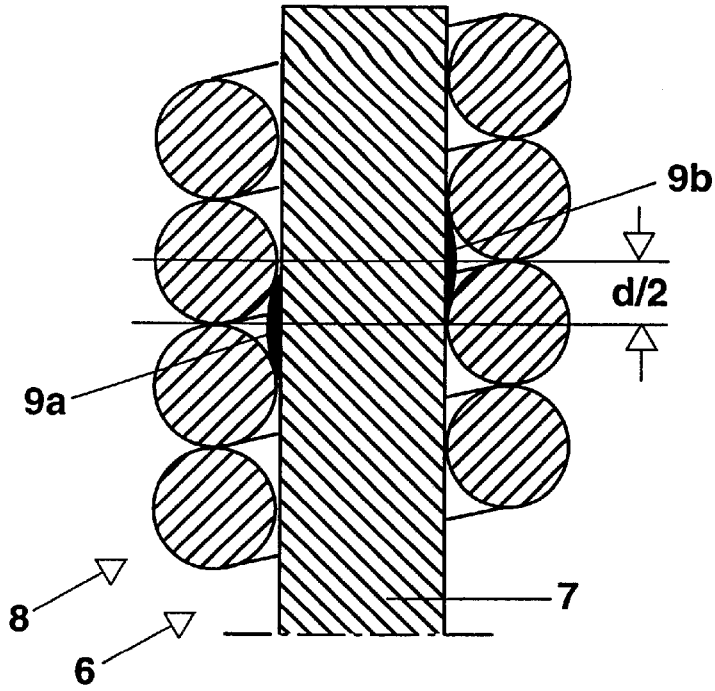
FIG. 2*a* shows an enlarged representation of the electrode 6. The helical member 8 comprises four turns touching one another which are pushed on the tip of the core pin 7. They are held by two bosses 9*a*, 9*b* which project laterally on the core pin and fix the helical member between the second and third turn. The mutual spacing of the two bosses 9, seen in the longitudinal direction of the core pin, is d/2, that is to say half the wire diameter d of the helical member. The projection of the bosses on the core pin is approximately 15 $\mu$m.
Figure 2B:
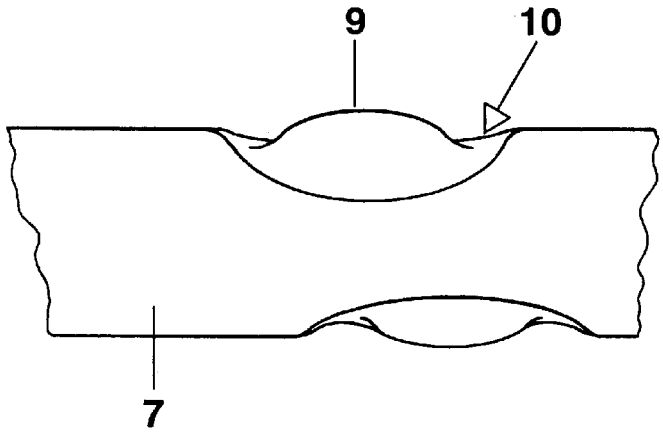

A core pin 7 is shown in FIG. 2*b* in a fashion resembling FIG. 2*a*, but still without the helical member. It is slightly rotated with respect to the representation of FIG. 2*a*. It can be seen as a result that here the boss 9 is surrounded over a large area by a narrow depression 10.

Figure 3:
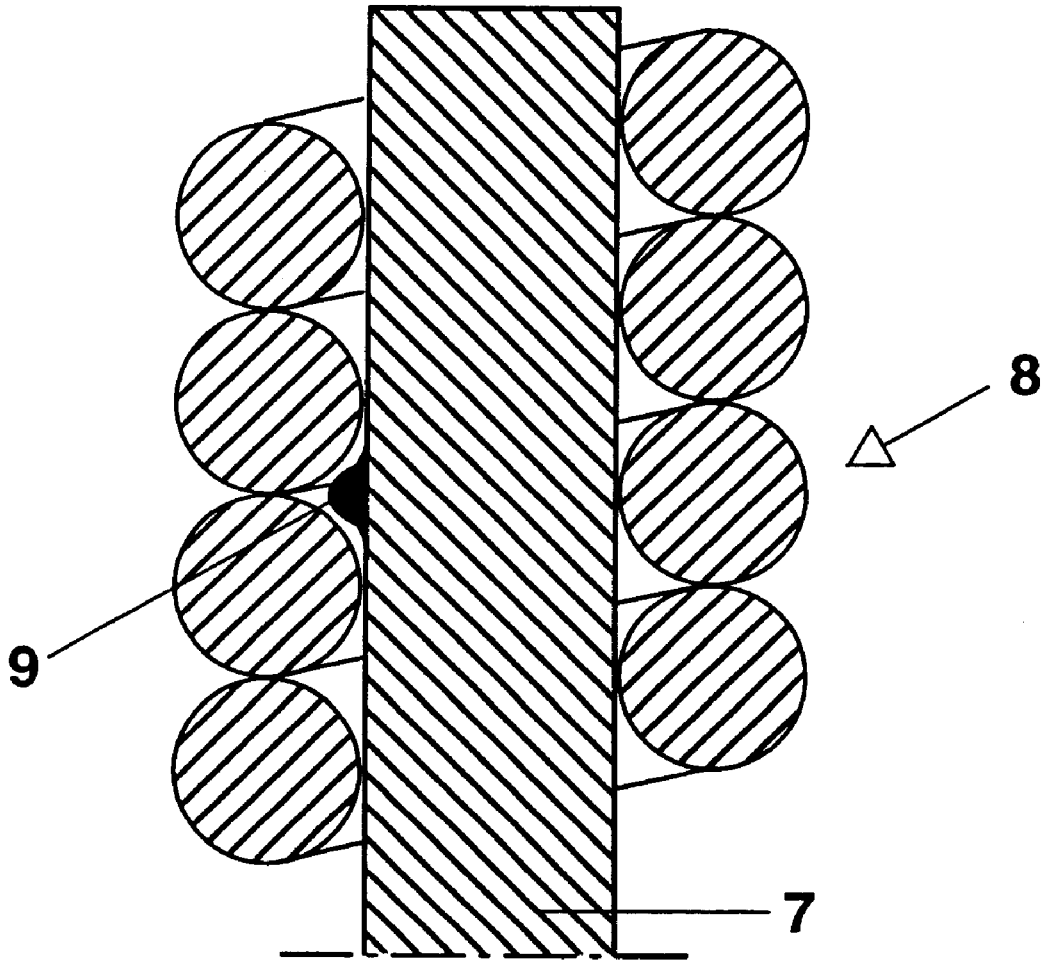

FIG. 3 shows another exemplary embodiment of an electrode, in which the helical member 8 is held only by one boss 9 on the core pin 7. The projection of the boss on the core pin is approximately 30 $\mu$m. It is sensible to use this embodiment chiefly in the case of large diameters (preferably at least 500 $\mu$m) of the core pin.

Figure 4:
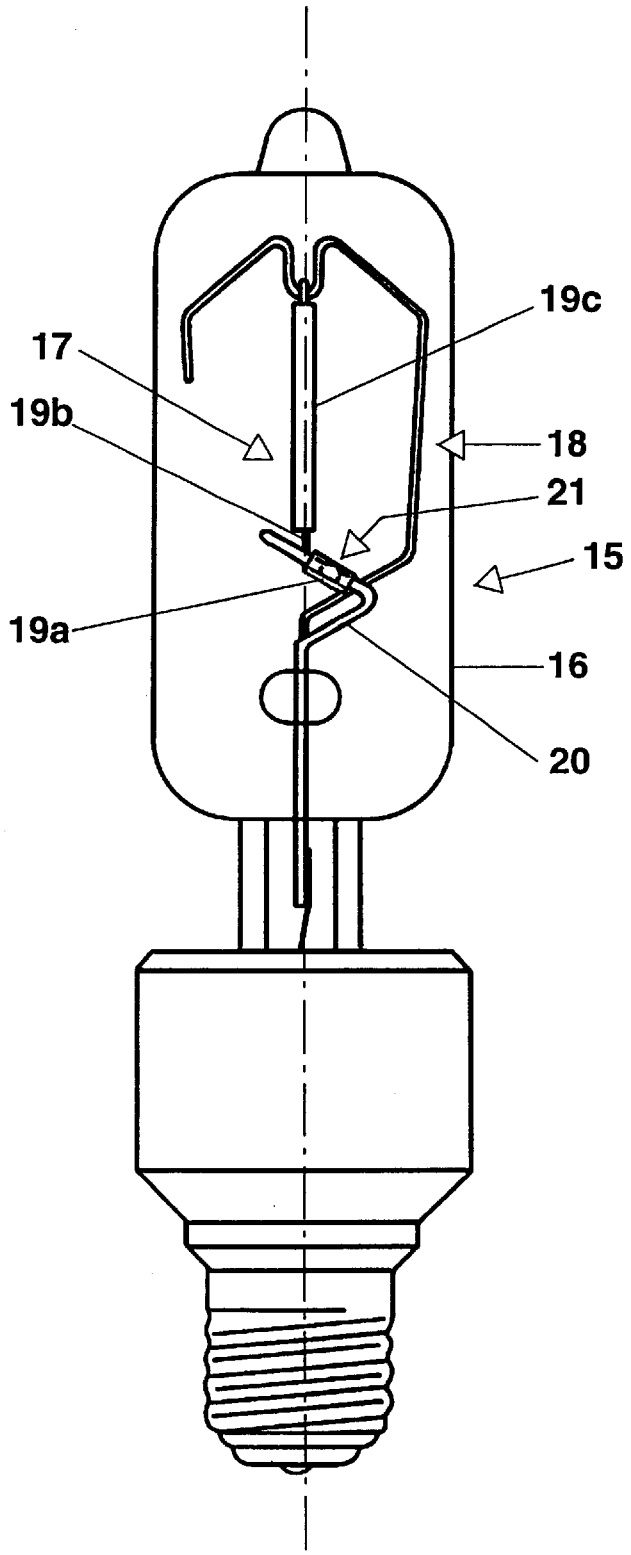

FIG. 4 shows a halogen incandescent lamp 15 with a power of 75 W. A doubly helically wound luminous element 17 is held in the middle of the bulb 16 by a frame 18. The doubly helically wound ends 19*a* of the luminous elements are attached to the luminous section 19*c* via a non-luminous section 19*b* which is not helically wound. The ends are pushed onto electrodes 20, which are bent in a V-shaped fashion and function as inner supply leads, and are held there by one (or two) boss(es) 21. The diameter of the electrode is 550 $\mu$m, the diameter of the primary helix of the luminous element is 200 $\mu$m. The projection of the boss 21 on the core pin is 20 $\mu$m. The projection is 10 $\mu$m in each case for two bosses.

Figure 5:
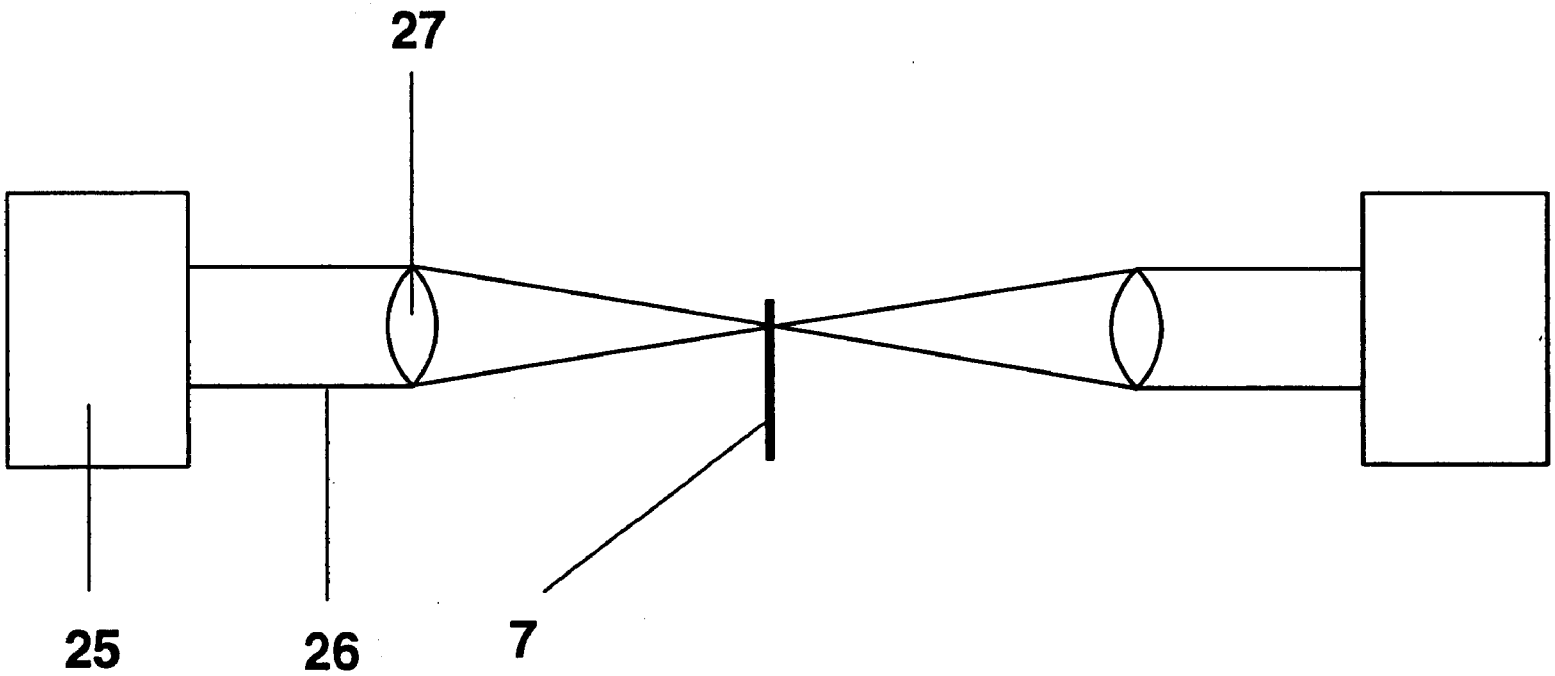

FIG. 5 shows the principle of how the bosses are produced. The core pin 7 with a diameter of 200 $\mu$m is irradiated with an Nd:YAG laser 25 from two opposite sides with an energy of 5 J. The laser beam 26 is focused onto the core pin 7 with the aid of a lens 27. A laser pulse with a period of approximately 6 $\mu$s is used to produce a boss.

What is claimed is:

1. Electrode made from a high-melting, electrically conducting material, comprising a cylindrical core pin (7) with a constant diameter with a pushed-on helical member (8) characterized in that a first and second outwardly projecting boss (9) extending beyond the diameter of the core pin (7) are laterally constructed on the core pin at a spacing from the tip, the second boss arranged on the side of the core pin opposite and offset with respect to the first boss, the helical member (8) being arranged with at least one turn between the boss (9) and the tip.

2. Electrode according to claim 1, characterized in that offsetting is done by half the wire diameter of the helical member or by half the pitch of the helical member.

3. Electrode according to claim 1, characterized in that the diameter of the core pin is approximately 150 to 5000 $\mu$m.

4. Electrode according to claim 1, characterized in that the projection of the boss beyond the core pin is approximately 5 to 30 $\mu$m.

5. Electrode according to claim 1, characterized in that the bosses are arranged approximately centrally relative to the helical member in the case of an electrode (6) for a high-pressure discharge lamp (1).

6. Lamp with an electrode according to claim 1.

7. Method for producing an electrode according to claim 1, characterized in that a core pin (7) is irradiated laterally with a laser beam (26) so that the material of the core pin melts locally and forms a boss, the helical member subsequently being pushed onto the core pin beyond the boss.

8. Method according to claim 7, characterized in that a core pin (7) is simultaneously irradiated from two sides with a laser beam (26) so that two bosses are formed.

* * * * *